US008410387B2

(12) United States Patent
Niklewski et al.

(10) Patent No.: US 8,410,387 B2
(45) Date of Patent: Apr. 2, 2013

(54) ELECTRICAL SWITCH

(75) Inventors: Gerhard Niklewski, Spaichingen (DE); Alfons Steidle, Spaichingen (DE); Daniel Hafen, Hausen ob Verena (DE)

(73) Assignee: Marquardt GmbH, Rietheim-Weilheim (DE)

( * ) Notice: Subject to any disclaimer, the term of this patent is extended or adjusted under 35 U.S.C. 154(b) by 0 days.

(21) Appl. No.: 13/185,839

(22) Filed: Jul. 19, 2011

(65) Prior Publication Data

US 2012/0006662 A1 Jan. 12, 2012

Related U.S. Application Data

(63) Continuation of application No. PCT/DE2010/000045, filed on Jan. 19, 2010.

(30) Foreign Application Priority Data

Jan. 21, 2009 (DE) ..... 10 2009 005 384

(51) Int. Cl.
*H01H 13/02* (2006.01)

(52) U.S. Cl. ..... 200/522

(58) Field of Classification Search ..... 200/522
See application file for complete search history.

(56) References Cited

U.S. PATENT DOCUMENTS

| | | | |
|---|---|---|---|
| 3,142,741 | A | 7/1964 | Bury |
| 6,104,105 | A | 8/2000 | Schaeffeler et al. |
| 6,469,268 | B1 | 10/2002 | Schaeffeler et al. |
| 6,736,220 | B1 | 5/2004 | Chan et al. |
| 2009/0026052 | A1 | 1/2009 | Steidle et al. |

FOREIGN PATENT DOCUMENTS

| | | | |
|---|---|---|---|
| DE | 197 08 939 | A1 | 10/1997 |
| DE | 199 30 558 | A1 | 1/2000 |
| DE | 10 2006 061 130 | A1 | 7/2007 |
| DE | 10 2007 005 510 | A1 | 8/2007 |

*Primary Examiner* — Briggitte R Hammond
(74) *Attorney, Agent, or Firm* — Burr & Brown

(57) ABSTRACT

An electrical switch for an electric tool with an electric motor including an actuating mechanism which can be adjusted between an initial position and a final position. The switch has a signaling device, which is operatively connected to the actuating mechanism, for generating a signal associated with the adjustment path of the actuating mechanism. The switch has a contact system, with the actuating mechanism having a switching effect on the contact system in one position, whereby the contact system is configured as a spring-action contact system.

8 Claims, 2 Drawing Sheets

ELECTRICAL SWITCH

CROSS REFERENCE TO RELATED APPLICATIONS

This application is a continuation of International Application No. PCT/DE2010/000045 filed Jan. 19, 2010, which designated the United States, and claims the benefit under 35 USC §119(a)-(d) of German Application No. 10 2009 005 384.0 filed Jan. 21, 2009, the entireties of which are incorporated herein by reference.

FIELD OF THE INVENTION

The invention relates to an electrical switch.

BACKGROUND OF THE INVENTION

Such switches are used for electric tools, for example for handheld electric tools, such as electric drills, hammer drills, electric screwdrivers or the like.

The electrical energy from the power supply system or a suitable rechargeable battery system is converted or influenced with the aid of the electrical switch in such a way that an electric motor for the electric tool, said electric motor being arranged downstream of the switch, is driven as determined by the operator. Thus, for example, the electric motor is switched on and/or off, braked, its speed is changed or else it is regulated in a torque-dependent and/or current-dependent fashion.

DE 197 08 939 A1 has disclosed an electrical switch which is suitable for these functions with an actuating mechanism which can be adjusted manually between an initial position and a final position. If the actuating mechanism is moved out of the initial position, a contact system of the switch is switched on so as to bring an electric motor of the electric tool into operation. Furthermore, the actuating mechanism is operatively connected to a potentiometer, which emits an electrical voltage corresponding to the adjustment path of the actuating mechanism. The potentiometer therefore acts as a signaling device for generating a signal associated with the adjustment path of the actuating mechanism, with this signal in this case being represented by the electrical voltage, whose magnitude corresponds to the adjustment path of the actuating mechanism. This signal is supplied to a control device in the switch, the control device operating the electric motor or subjecting said electric motor to open-loop and/or closed-loop control depending on this signal. For example, the control device sets the speed of the electric tool corresponding to the adjustment of the actuating mechanism performed by the user. If the actuating mechanism enters the final position, a contact system which serves to bridge the control device is switched on, whereupon the electric motor is operated on the full voltage. The actuating mechanism therefore has a switching effect on the respective contact system in each position, namely when it leaves the initial position and when it reaches the final position.

It has been shown with the known switch that the contact system can fail prematurely. In particular, in switches using open-loop or closed-loop control electronics when using electric tools which are subject to severe stress, the contact system, to be precise primarily that for the bridging contact, can be caused to fail. This negative effect, the so-called teasing of the contact system, primarily occurs in low-voltage applications in the AC voltage and DC voltage sector. Furthermore, teasing is also established when the electric tool is operated under vibrations, i.e. in the percussion drilling mode or in the hammer drilling mode, for example.

SUMMARY OF THE INVENTION

The invention is based on the object of developing the electrical switch in such a way that the failsafety is improved, in particular in the vibrating mode.

In the switch according to the invention, the contact system is configured as a spring-action contact system, whereby the contact system is switched over with a snap-action movement. Damaging oscillations and/or creeping switching movements between the switched-on state and the switched-off state of the contact system, which may occur primarily in the event of high loads, severe stresses, vibrations, impacts or the like, are avoided with the switch according to the invention, whereby the operational reliability of said switch is increased. In a particularly preferred configuration, therefore, an electrical switch for electric tools in the AC and/or DC sector, i.e. an electric tool switch with an open-loop or closed-loop control function in the manner of an "accelerator function", is provided which has a spring-action contact system for relieving the load on and/or for protecting the bridging contact from loads, in particular from teasing of the contact system.

Generally, the switch can have a housing. The signaling device can interact with a control device for the electric tool. The control device is used for operating the electric tool, to be precise for the open-loop and/or closed-loop control of the electric motor. For example, the speed, the torque or the like can be adjusted with the aid of the control device corresponding to the signal generated by the signaling device, i.e. depending on the adjustment path of the actuating mechanism, by the user. It is, of course, possible for the control device to be arranged at a suitable point in the electric tool. However, an option is for the control device to likewise be located in the housing.

Preferably, the contact system configured as a spring-action contact system is the bridging contact system for the control device. The actuating mechanism has a switching effect on this contact system in the final position, with the result that this contact system is switched on so as to apply the full voltage to the electric motor. Since the full voltage for the electric tool is therefore applied to the bridging contact system, particularly effective protection from premature destruction of this contact system which is subjected to high electrical loads is thus provided.

The switch can additionally have a further contact system. This further contact system serves to switch on the voltage supply for the control device by virtue of the actuating mechanism having a switching effect on the further contact system when it is adjusted out of the initial position. When the contact system is switched on, the control device is then operated in such a way that a reduced voltage, depending on the adjustment path of the actuating mechanism, is applied to the electric motor by means of the control device. In a known manner, the reduced voltage may be a pulse width modulation (PWM) for a DC electric motor or phase gating and/or phase chopping control for an AC electric motor, whereby the electric motor is operated at the speed corresponding to the corresponding signal from the signaling device, for example. This further contact system is less susceptible owing to the relatively low voltage to be switched and the relatively low electrical loading and can therefore have a conventional configuration.

The contact system has a fixed contact and a switching contact. In a first position, the switching contact is removed from the fixed contact such that the contact system is switched off. In a second position, the switching contact bears against the fixed contact in such a way that the contact system is switched on. The switching contact for one contact system, namely for the bridging contact system, is mounted movably with respect to the actuating mechanism. For this purpose, the switching contact can be arranged on a carriage. The carriage and therefore also the switching contact are operatively connected to the actuating mechanism by means of an elastic element, which may be a compression spring acting on the carriage, for example. As a result, in the event of a movement of the actuating mechanism into and/or out of the final position, the elastic element is tensioned, with the result that the carriage, together with the switching contact, is then switched over between the two positions in the manner of a snap-action movement. In a compact arrangement, the switching contact can be configured as a type of contact bridge for bridging two fixed contacts. The switching contact of the further contact system, which serves to switch on the voltage supply to the control device and/or to the signaling device, is configured as a pivotably mounted lever. A cam on the actuating mechanism acts on one lever arm of the lever in the initial position in such a way that the switching contact is removed from the fixed contact. When the actuating mechanism is adjusted out of the initial position, the cam releases one lever arm, as a result of which the other lever arm is caused to bear against the fixed contact by the action of the force of a spring.

Expediently, the signaling device has a wiper, with the wiper being arranged on the actuating mechanism. In the event of a manual movement of the actuating mechanism by means of the user, the wiper interacts with a contact face, which is associated with at least one section of the adjustment path, so as to make electrical contact in order to generate the signal corresponding to the adjustment path of the actuating mechanism. For this purpose, the contact face is configured as a type of potentiometer track and is located as a resistive face on a printed circuit board. The signal which comprises a control voltage corresponding to the respectively tapped-off potentiometer track is supplied to the control device. The electric motor is then operated corresponding to this signal as setpoint value depending on the adjustment path of the actuating mechanism by means of the control device.

The advantages achieved with the invention consist in particular in that the contact system is protected against premature failure and therefore its life and the operational reliability for the switch is increased. In particular, the bridging contact is protected against failure as a result of particular stresses, for example owing to teasing under vibration. The use of the snap-action switching contact system in an electronic switch with open-loop and/or closed-loop control function for AC and/or DC operation in an electric tool enables particular protection of the contact system while maintaining or without dispensing with the metered runup and/or ramp-up characteristic for the electric motor of the electric tool.

BRIEF DESCRIPTION OF THE DRAWINGS

An exemplary embodiment of the invention with various developments and configurations is illustrated in the drawings and will be described in more detail below.

DETAILED DESCRIPTION OF THE INVENTION

Figure 1:
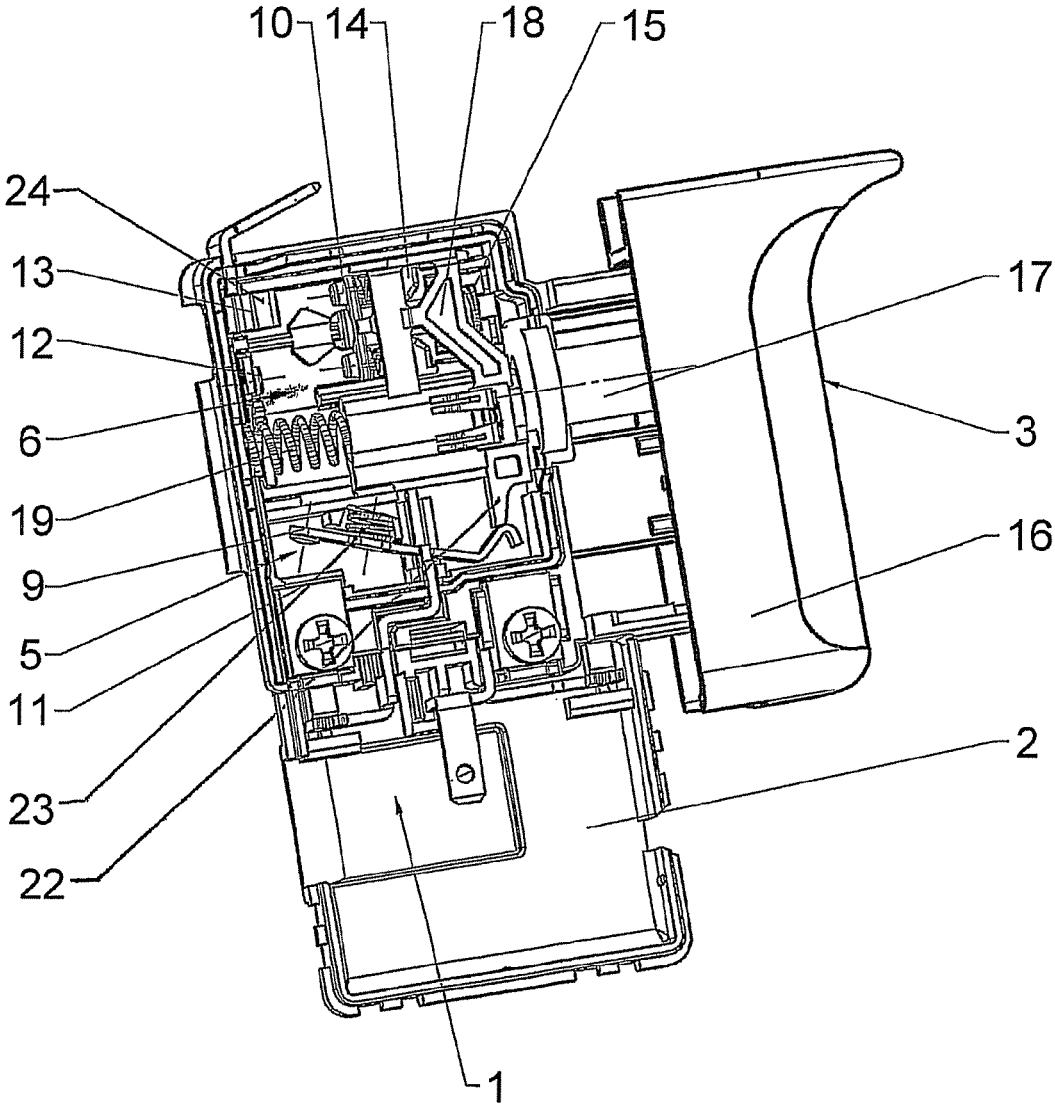
FIG. 1 shows an electrical switch for an electric tool with a cut-away housing.

FIG. 1 shows an electrical switch 1 for an electric tool with an electric motor, such as for an electric drill, a hammer drill, an electric screwdriver or the like. The switch 1 has a housing 2 and an actuating mechanism 3, which can be adjusted by the user manually between an initial position and a final position. The actuating mechanism 3 is operatively connected to a signaling device 4 (shown schematically in FIG. 2) for generating a signal associated with the adjustment path of the actuating mechanism 3. In other words, for example, the value, the magnitude, the nature or the like of the signal corresponds to the adjustment path of the actuating mechanism 3. A contact system 5, 6 is located in the housing 2, with the actuating mechanism 3 having a switching effect on the respective contact system 5, 6 in a respective position, i.e. when the respective movement position is reached and/or left. The actuating mechanism 3 comprises a pushbutton 16 as the operating lever for manual movement by the user, a plunger 17 which moves into the housing 2 and a slide 18 in the housing 2, said slide 18 being rigidly connected to the plunger 17, the plunger 17 together with the slide 18 being capable of being moved counter to the force of a restoring spring 19.

Figure 2:
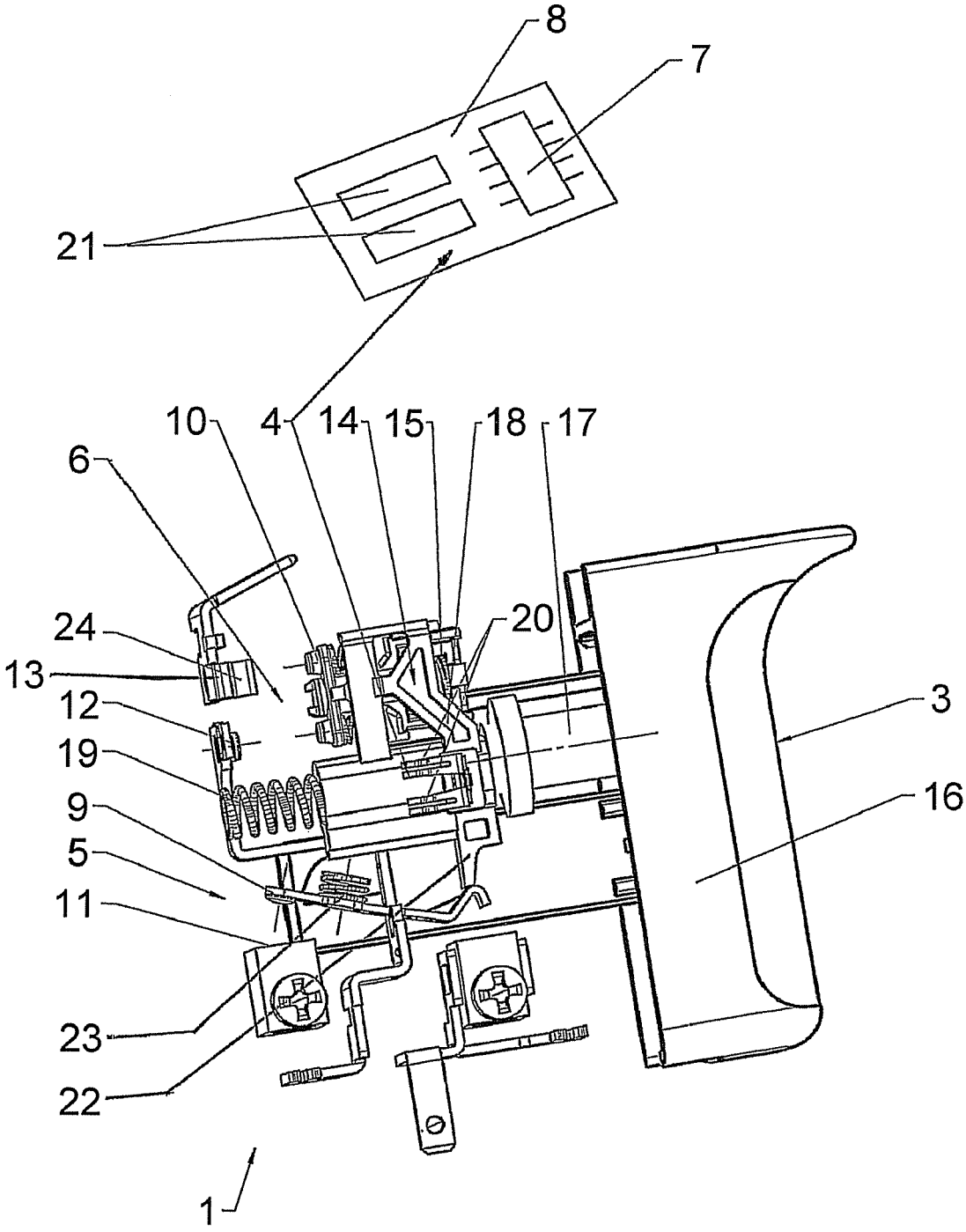
FIG. 2 shows the individual part of the switch shown in FIG. 1 without the housing.

The signaling device 4 is connected to a control device 7, which is represented as an integrated circuit in FIG. 2, for operating the electric tool. Open-loop and/or closed-loop control of the electric motor in the electric tool, such as the speed, torque or the like thereof, is enabled with the aid of the control device 7 depending on the adjustment path of the actuating mechanism 3. For example, the control device 7 can function with open-loop and/or closed-loop control of the speed of an electric motor operated on DC voltage with pulse width modulation (PWM) control. If the electric motor is one which is operated on AC voltage, the control device 7 can function with open-loop and/or closed-loop control of the speed of the electric motor with phase gating and/or phase chopping control. The control device 7 is arranged on a printed circuit board 8, which is expediently located together with the control device 7 in the housing 2.

The contact system 5 serves to switch on the supply voltage for the control device 7 and/or for the electric motor. For this purpose, the actuating mechanism 3 has a switching effect on the further contact system 5 in the event of an adjustment out of the initial position, by virtue of the contact system 5 being switched over from the switched-off state to the switched-on state. When the contact system 5 is switched on, a voltage which is reduced depending on the adjustment path of the actuating mechanism 3 is applied to the electric motor by pulse width modulation, phase gating, phase chopping or the like by means of the control device 7. The electric motor is thus operated at a lower speed than the maximum possible speed, with the magnitude of the speed corresponding to the adjustment path of the actuating mechanism 3. In other words, the manual adjustment of the actuating mechanism 3 by the user acts as an "accelerator" function for the electric motor. The contact system 6 is the bridging contact system for the control device 7, with the actuating mechanism 3 having a switching effect on the contact system 6 in the final position. In the final position of the actuating mechanism 3, therefore, the contact system 6 which was previously located in the switched-off state is switched on, in which case the full voltage is applied to the electric motor with bridging of the control device 7, with the result that said electric motor runs at maximum speed. When the actuating mechanism 3 is reset, the contact system 6 is then switched off again as the final position is left.

The contact system 5 has a fixed contact 11 and a switching contact 9 with a largely conventional configuration. The switching contact 9 of the further contact system 5 is configured as a pivotably mounted lever, as can be seen in particular in FIG. 2. A cam 22 on the plunger 17 of the actuating mechanism 3 acts on one lever arm of the switching contact 9 in the initial position such that the switching contact 9 is removed from the fixed contact 11 in a first position, whereby the contact system 5 is switched off. In the event of the adjustment of the actuating mechanism 3 out of the initial position, the cam 22 releases one lever arm such that the other lever arm is caused to bear against the fixed contact 11 by the action of the force of a spring 23. In this second position, in which the switching contact 9 bears against the fixed contact 11, the contact system 5 is therefore switched on. When the actuating mechanism 3 is reset, the contact system 5 remains switched on until the initial position is reached and is then switched off in the initial position.

The contact system 6, on the other hand, is configured differently than in the case of previous "accelerator" switches for electric tools as a spring-action contact system which switches over with a snap-action movement, as will be explained in more detail below.

The contact system 6 likewise has a fixed contact 12, 13 and a switching contact 10. In a first position, which can be seen from FIG. 1, the switching contact 10 is removed from the fixed contact 12, 13, with the result that the contact system 6 is switched off. In a second position, which is not shown in any more detail, the switching contact 10 bears against the fixed contact 12, 13 whereby the contact system 6 is switched on. The switching contact 10 is mounted such that it can move with respect to the actuating mechanism 3 by means of a carriage 14. Furthermore, the switching contact 10 is operatively connected to the actuating mechanism 3 by means of an elastic element 15, to be precise a compression spring, by virtue of the compression spring 15 being arranged between the slide 18 and the carriage 14. Since the compression spring 15 acts on the carriage 14 correspondingly, in the event of a movement of the actuating mechanism 3 into and/or out of the final position thereof, the switching contact 10 can be switched over between the first and the second position of the contact system 6 in the manner of a snap-action movement. In the final position of the actuating mechanism 3, therefore, secured contact is thus provided between the switching contact 10 and the fixed contacts 12, 13 even under severe use conditions and high loads. As can further be seen from FIG. 2, the switching contact 10 is configured as a type of contact bridge for bridging the two fixed contacts 12, 13, which further increases the contact reliability. Moreover, in FIG. 1 and FIG. 2, the fixed contact 13, which is configured in the same way as the fixed contact 12, is covered by a contact lug 24. The contact lug 24 is used for the electrical connection for the supply of voltage to the components located on the printed circuit board 8, such as the control device 7, for example.

As can be seen from FIG. 2, the signaling device 4 has a wiper 20. The wiper 20 is arranged on the actuating mechanism 3, to be precise on the plunger 17 and/or on the slide 18 and is located within the housing 2. The wiper 20 interacts with a contact face 21, which is associated with at least one section of the adjustment path of the actuating mechanism 3, so as to produce electrical contact. The contact face 21 is configured as a resistive face as a type of potentiometer track and is likewise located on the printed circuit board 8. Owing to the electrical contact between the wiper 20 and the contact face 21, a signal corresponding to the adjustment path of the actuating mechanism 3 is generated, with this signal being supplied as setpoint value to the control device 7 for correspondingly operating the electric motor depending on the adjustment path of the actuating mechanism 3.

The invention is not restricted to the exemplary embodiment described and illustrated. Instead, it also includes all technical developments within the scope of the invention defined by the patent claims. For example, such an electronic switch can be used not only in electric tools which are operated on the mains and/or by a rechargeable battery and are provided with an open-loop or closed-loop control function as an "accelerator function" with percussion, hammer, vibrating operation or the like, but also in electrical appliances supplied from a voltage source, such as gardening appliances, kitchen appliances or the like. Advantageously, when using this switch the reliability and operational reliability of the corresponding appliance is even increased under severe use conditions and under high loads.

LIST OF REFERENCE SYMBOLS

1: (Electrical) switch
2: Housing
3: Actuating mechanism
4: Signaling device
5, 6: Contact system
7: Control device
8: Printed circuit board
9: Switching contact (of further contact system)
10: Switching contact (of contact system)
11: Fixed contact (of further contact system)
12, 13: Fixed contact (of contact system)
14: Carriage
15: Elastic element/compression spring
16: Pushbutton
17: Plunger
18: Slide
19: Restoring spring
20: Wiper
21: Contact face
22: Cam
23: Spring
24: Contact lug

We claim:

1. An electrical switch for an electric tool with an electric motor, comprising an actuating mechanism that can be adjusted between an initial position and a final position, a signaling device that is operatively connected to the actuating mechanism for generating a signal associated with an adjustment path of the actuating mechanism, a control device for operating the electric motor, and a contact system, wherein the actuating mechanism has a switching effect on the contact system in one position, the contact system is configured as a spring-action contact system having a snap-action movement, the contact system is the bridging contact system for the control device, and the actuating mechanism has a switching effect on the contact system in the final position such that the contact system is switched on so as to apply the full voltage to the electric motor.

2. The electrical switch as claimed in claim 1, wherein the switch has a housing, the signaling device interacts with the control device for one of open-loop and closed-loop control of the electric motor depending on the adjustment path of the actuating mechanism, and the control device is located in the housing.

3. The electrical switch as claimed in claim 1, wherein the contact system has a fixed contact and a switching contact, wherein, in a first position, the switching contact is remote from the fixed contact in such a way that the contact system is switched off and, in a second position, the switching contact bears against the fixed contact in such a way that the contact system is switched on.

4. The electrical switch as claimed in claim 1, wherein the signal device has a wiper arranged on the actuating mechanism, the wiper interacts with a contact face, which is associated with at least one section of the adjustment path, the contact face being a resistive face which is configured as a potentiometer track located on a printed circuit board, so as to make electrical contact in order to generate the signal corresponding to the adjustment path of the actuating mechanism, and the signal from the control device is supplied as a setpoint value for operating the electric motor depending on the adjustment path of the actuating mechanism.

5. The electrical switch as claimed in claim 1, wherein the switch has a further contact system, the actuating mechanism has a switching effect on the further contact system in the event of an adjustment out of the initial position such that the contact system is switched on for supplying voltage to the control device, and a voltage, which is reduced depending on the adjustment path of the actuating mechanism, is applied to the electric motor by the control device when the contact system is switched on.

6. The electrical switch as claimed in claim 5, wherein the switching contact of the further contact system is configured as a pivotably mounted lever, and a cam on the actuating mechanism releases one lever arm as it is adjusted out of the initial position such that the other lever arm is caused to bear against the fixed contact by virtue of the effect of the force of a spring.

7. The electrical switch as claimed in claim 1, wherein the switching contact of the contact system is mounted movably with respect to the actuating mechanism, for example by means of a carriage, the switching contact is operatively connected to the actuating mechanism by an elastic element, such that, in the event of a movement of the actuating mechanism relative to the final position, the switching contact is switched over between the two positions with the snap-action movement, and the switching contact is configured as a type of contact bridge for bridging two fixed contacts.

8. The electrical switch as claimed in claim 7, wherein the elastic element is a compression spring.

* * * * *